US005094397A

United States Patent [19]

Peters et al.

[11] Patent Number: 5,094,397

[45] Date of Patent: Mar. 10, 1992

[54] UNIT FUEL INJECTOR WITH INJECTION CHAMBER SPILL VALVE

[75] Inventors: Lester L. Peters; Julius P. Perr, both of Columbus, Ind.

[73] Assignee: Cummins Engine Company, Inc, Columbus, Ind.

[21] Appl. No.: 653,704

[22] Filed: Feb. 11, 1991

[51] Int. Cl.[5] ..... F02M 47/02

[52] U.S. Cl. ..... 239/88; 239/89; 239/91; F02M/47/02

[58] Field of Search ..... 239/88-91, 239/93, 95, 124, 125

[56] References Cited

U.S. PATENT DOCUMENTS

| | | | |
|---|---|---|---|
| 1,852,191 | 4/1932 | Salisbury | 239/88 |
| 2,055,580 | 9/1936 | Larsson et al. | 239/91 |
| 2,762,654 | 9/1956 | Purchas, Jr.; et al | 239/90 |
| 4,235,374 | 11/1980 | Walter et al. | 239/90 |
| 4,410,137 | 10/1983 | Perr | 239/95 |
| 4,420,116 | 12/1983 | Warlick | 239/95 |
| 4,463,901 | 8/1984 | Perr et al. | 239/95 |
| 4,471,909 | 9/1984 | Perr | 239/89 |
| 4,699,320 | 10/1987 | Sisson et al. | 239/90 |

*Primary Examiner*—Andres Kashnikow
*Assistant Examiner*—Lesley Morris
*Attorney, Agent, or Firm*—Sixbey, Friedman, Leedom & Ferguson

[57] ABSTRACT

A unit fuel injector assembly (88) periodically injects fuel of a variable quantity on a cycle to cycle basis as a function of the pressure of fuel supplied to the injector from a source of fuel and at a variable time during each cycle as a function of the pressure of the timing fluid supplied to the injector from a source of timing fluid. A reciprocating plunger assembly (146) is received within the injector body (106) and includes an upper plunger section (148), a lower plunger section (150) and an intermediate plunger section (152) in order to define a variable volume timing chamber (138), a variable volume injection chamber (162) and a variable volume compensation chamber (176). Biasing means including an upper compression spring (180) and lower compression spring (182) are arranged in the compensation chamber (176) to independently bias the lower plunger section (150) and the imtermediate plunger section (152) in opposite directions to tend to collapse the timing chamber (138) and injection chamber (162). Provision is made for causing both the timing chamber (138) and injection chamber (162) to be spilled at the end of each injection event. A spill valve (204) for spilling fuel from the injection chamber (162) is located at a lower end portion of the injection chamber (162), is spring biased to a closed position and is openable by an end face of the injection plunger (150) coming into contact with a contact piece (210) of a spill valve (204) at the end of an injection stroke.

16 Claims, 3 Drawing Sheets

UNIT FUEL INJECTOR WITH INJECTION CHAMBER SPILL VALVE

BACKGROUND OF THE INVENTION

1. Technical Field

This invention relates to a periodic fuel injector designed to inject fuel pulses of variable quantity and timing into the cylinder of an internal combustion engine. In particular, this invention relates to an improved means for spilling fuel from an injection chamber of the fuel injector at the end of an injection stroke in order to achieve a sharp end of injection.

2. Background Art

To achieve a sharp end of injection, unit type fuel injectors typically spill the trapped volume of fuel in the injection chamber with a spill port, at the end of an injection stroke. A sharp end of injection is desirable in order to increase engine performance, improve fuel efficiency and abate undesirable exhaust emissions.

During the downward stroke of an injector plunger, extremely high injector pressure must be attained, e.g., 15,000 psi or greater, to insure that a sufficient quantity of fuel can be injected within the short interval during each injector cycle when injection should occur. Unless injection takes places at exactly the right time, engine performance can degrade dramatically. High pressures are also essential to insure that the fuel entering the combustion chamber is adequately atomized and mixed with the compressed air. Fuel pressures as high as 30,000 psi have been found to be desirable in some injector designs.

To achieve such high pressures, the unit injector's plunger must be accelerated to a relatively high velocity during its injection stroke and must be very carefully matched with the central bore of the injector body in which the plunger is designed to reciprocate in order to avoid fuel leakage.

The extremely high fuel pressure at which the injector is required to operate further exacerbates the need for very close tolerance because the high pressure causes the injector body to dilate. Unless the injector body is made rigidly to resist substantial high pressure induced dilation, fuel leakage and unpredictable fuel pressure losses may occur.

The need for fuel injection at high pressure also complicates the need for very accurate injection timing as discussed above. For example, high injection pressure requires high plunger velocity but such high velocities lead to difficulties in achieving a sharp end of injection. In particular, high pressure fuel injection can be terminated by causing the injector plunger to engage a stop but such engagement may cause the plunger to bounce back and thus produce a dribbling effect which can lead to poor combustion, reduced fuel efficiency and increased emissions.

To avoid the problem described above, it has been proposed to provide a slightly raised dimple on the cam lobe controlling the plunger in order to place a "crush load" on the injector plunger at the end of the injection event and thereby hold the plunger very tightly against a stop such as an injector cup. See, e.g., Perr U.S. Pat. No. 4,471,909. While this arrangement provides sharp fuel cut-off, it also places stresses on the plunger actuation mechanism, thus adversely affecting the durability of the fuel injection system.

FIG. 3 depicts a fuel injection chamber spill port arrangement in accordance with Perr et al. U.S. Pat. No. 4,463,901, the entire contents of which is hereby incorporated by reference. FIG. 3 shows lower plunger section 150 in its lowermost position, wherein the volume of the injection chamber is brought to a minimum and a fuel drain passage extension 194, including a radial portion **194*a* and an axial portion 194*b* form a path of communication between the injection chamber and fuel drain passage 188 in order to quickly reduce the pressure within the injection chamber 162** to produce a positive and predictable end to the injection event. This also reduces the requirement for a large "hold down" force to be created by fluid in a timing chamber, thus reducing camshaft loading.

In the above prior art arrangement, the small amount of fuel discharged through fuel drain extension 194 and passage 198 is recirculated back to the fuel supply. Final downward movement of the lower injector plunger ceases upon contact of the lower injector plunger with the upper surface of a tip valve spring housing 127. It can also be seen in FIG. 3 that a similar spill port 158 is provided for spilling fuel from a timing chamber defined between upper injection plunger 148 and intermediate plunger section 152.

Walter et al. U.S. Pat. No. 4,235,374 similarly discloses a unit injector provided with spill ports for collapsing a timing chamber and dumping fuel from an injection chamber.

A problem exists with spill ports of the type just mentioned. Spill ports have high leakage when located in injector barrels which are being dilated by high injection pressure. Furthermore, such spill ports can tend to side load the plunger if there are not provided multiple ports to balance the forces, thus creating wear which can result in fuel leakage within the injector assembly. Also, spill ports are typically rectangular EDM'ed ports which are costly and difficult to locate accurately with respect to a spill groove necessarily provided in the plunger.

Salisbury U.S. Pat. No. 1,852,191 discloses a centrally located spill port arrangement to allow termination of injection before the injection plunger completes its working stroke. The spill port is opened by a linkage and actuating mechanism which operates independent of the plunger. Thus, a complicated separate mechanism is required to spill fuel from the injection chamber.

SUMMARY OF THE INVENTION

An object of the present invention is to overcome the problems associated with using a spill port to spill fuel from an injection chamber in a unit fuel injector, as described above. Specifically, it is an object of the present invention to provide an uncomplicated valve arrangement for spilling fuel from the injection chamber to ensure a sharp end of injection, which is less costly to manufacture than conventional spill ports, does not side-load the plunger and avoids leakage due to dilation by high injection pressure.

Another object of the invention is to utilize such a valve arrangement in a closed nozzle unit injector in such a manner that the spilled fuel forces assist in biasing a tip valve element of the fuel injector into a closed position, thus further ensuring an accurately controlled fuel injection cut-off.

These and other objects are achieved by the present invention which, in one aspect, provides a unit fuel injector with a spill valve means for spilling fuel from an injection chamber at the end of each fuel injection stroke of an injection plunger, wherein the spill valve means is openable via mechanical contact of the valve means with the plunger.

In another aspect of the invention, the spill valve means is so arranged in a closed nozzle fuel injector that fuel which is spilled therefrom flows into a tip valve spring housing, thereby assisting in biasing a tip valve element to a closed position.

In the preferred embodiment, the novel valve arrangement is incorporated into a closed nozzle periodic fuel injector. However, the invention is applicable to open nozzle fuel injectors as well, wherein it is also desirable to spill the injection chamber at the end of an injection stroke in order to provide a precise termination of fuel injection.

Also in the preferred embodiment, the spill valve means is spring biased to a closed position by the same spring which biases the tip valve element of the fuel injector into a closed position.

These and other objects and features of the present invention will become evident and fully understood from the following detailed description of the preferred embodiment, taken in connection with the appended drawings.

DETAILED DESCRIPTION OF THE PREFERRED EMBODIMENT

Figure 1:
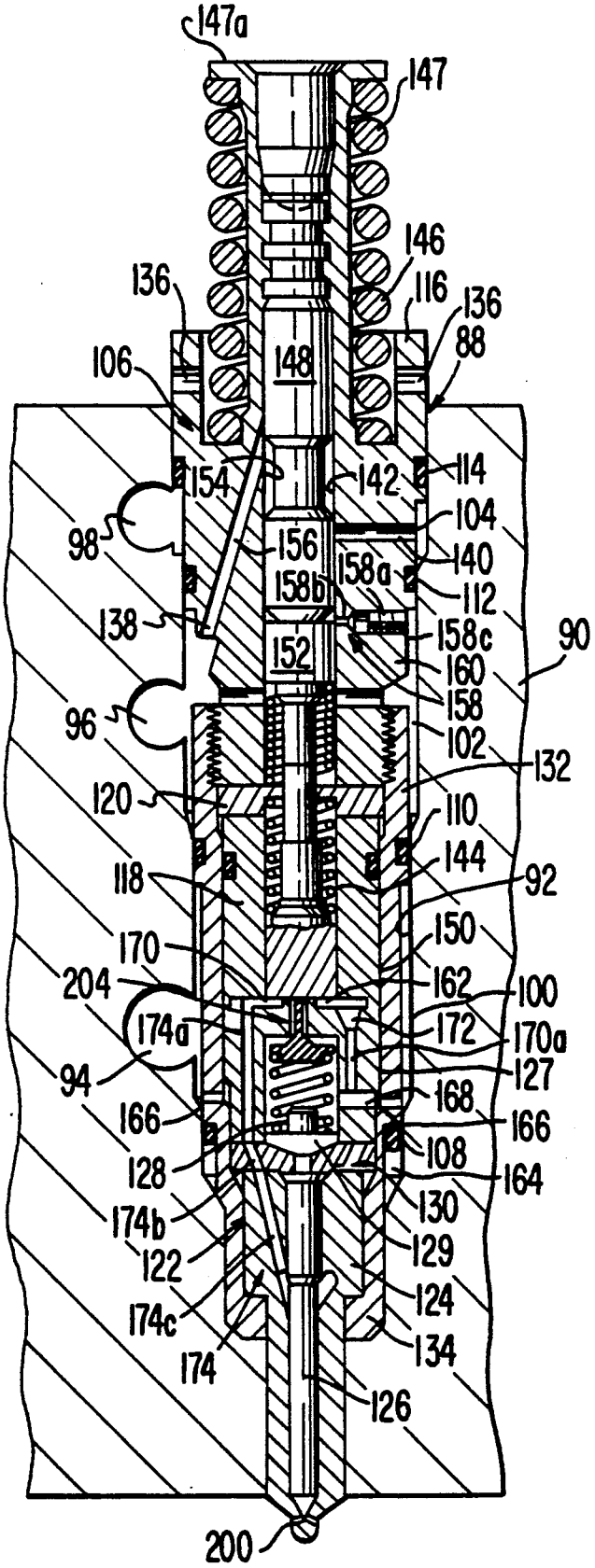
FIG. 1 is a cross-sectional view of a fuel injector having independently controlled timing and metering and incorporating a injection chamber spill valve arrangement in accordance with the present invention.

FIG. 1 illustrates a practical embodiment of a fuel injector assembly in accordance with the present invention. The illustrated injector is of the general type disclosed in U.S. Pat. No. 4,463,901 which has been incorporated by reference herein. In this type of injector, independent control of injection timing and fuel metering is attained, as described in detail below.

For convenience, elements of the illustrated fuel injector corresponding to those in the fuel injector of U.S. Pat. No. 4,463,901 are referenced with the same numbers used in the patent.

Injector assembly 88 is illustrated in combination with a broken cross-sectional view of an engine head 90 containing a recess 92 for receiving the injector assembly. Recess 92 is intersected at axially spaced locations by three internal flow paths including a fuel supply flow path 94, a drain flow path 96 and a timing fluid flow path 98. Each of these flow paths may be formed by drilling out a single bore which intersects with each of a plurality of injector receiving recesses in a multi-cylinder engine. The various flow paths remain fluidically isolated by the provision of seal means which fluidically isolate three annular flow chambers 100, 102 and 104 of recess 92 surrounding the exterior surface of the injector body 106. In particular, the seal means includes a copper washer 108 and a second O-ring seal 110 received in corresponding annular recesses in the exterior surface of injector body 106 to define flow chamber 100 for interconnecting flow path 94 with the fuel injector assembly 88. O-ring 110 and O-ring 112 define a second annular flow path for interconnecting the drain flow path 96 and the injector assembly 88. A final O-ring 114, along with O-ring 112, define annular flow chamber 104 for interconnecting the timing fluid flow path 98 with the injector assembly 88.

Injector body 106 is formed of multiple components including an upper injector barrel 116, a lower injector barrel 118, an injector spring retainer 120, and a tip nozzle assembly 122. Tip nozzle assembly 122 includes a tip nozzle housing 124 containing an axial bore for receiving a tip valve element 126, a tip valve spring housing 127 containing a cavity for receiving a tip valve spring, a spring seat 129 connected to the upper end of tip valve element 126 and a nozzle stop 130 positioned between tip nozzle housing 124 and spring housing 127.

The upper end of tip valve spring 128 is seated against inner valve element 202 (see FIGS. 2A and 2B) of the inventive injection chamber spill valve 204. The structure and operation of spill valve 204 will be described in further detail below.

A cup-shaped injector assembly retainer 132 is arranged to hold the upper injector barrel 116, the injector spring retainer 120, the lower injector barrel 118, the tip valve spring housing 127, the nozzle stop 130 and the tip nozzle housing 124 in axially stacked, tight engagement. A lower, inturned radial flange 134 at the lower end of the injector assembly retainer 132 engages a shoulder on the exterior of tip nozzle housing 124 and an internal thread on the inside of injector assembly retainer 132 engages a shoulder on the exterior of tip nozzle housing 124 and an internal thread on the inside of injector assembly retainer 132 engages an exterior thread on the lower portion of upper injector barrel 116 to allow the entire assembly to be held in tight engagement. The injector assembly 88 is normally held in position by a clamp (not illustrated) and may be removable by a tool designed to engage radial holes 136 located in the section of upper injector barrel 116 which extends above the upper surface of head 90.

Timing fluid under variable control pressure from flow path 98 is transferred to the timing chamber 138 (shown in collapsed condition in FIG. 1) through a radial timing passage 140 formed in upper injector barrel 116 between annular flow chamber 104 and the upper central bore section 142 contained in upper injector barrel 116. Lower injector barrel 118 contains a lower central bore section 144 aligned with upper section 142.

A plunger assembly 146, received in upper and lower central bore sections 142 and 144, includes an upper plunger section 148, a lower plunger section 150 and an intermediate plunger section 152. In addition, plunger assembly 146 includes a plunger spring 147 connected with upper plunger section 148 by a plunger spring retainer **147*a* for biasing the upper plunger section 148 in an upward direction. Upper plunger section 148 contains an annular recess 154 positioned above timing passage 140 to receive all timing fluid and fuel which may leak upwardly between the plunger assembly 146** and injector body 106. A leakage passage 156 extends axially and radially downwardly from a position opening into upper central bore section 142 adjacent recess 154 into annular flow chamber 102. A timing fluid drain passage 158 contained in upper injector barrel 116 is formed by a radial passage 158*a* containing a throttling orifice 158*b* at one end and a threaded plug 158*c* at the other end. Timing fluid drain passage 158 further includes a downwardly angled discharge branch 160 which connects with the annular flow chamber 102.

Fuel enters the injection chamber 162 (illustrated in collapsed condition in FIG. 1) through a fuel supply passage 164 including a pair of opposed radial passages 166 contained in injector assembly retainer 132. From radial passages 166, fuel passes into a radial passage 168 and axial passage 174*a* contained in tip valve spring housing 127 opening in a circular groove 170 on the top surface of tip valve spring housing 127. Radial passage 168 also supplies fuel under supply pressure to the interior of spring housing 127 to apply fuel supply pressure to valve elements 126 and 202. Fuel enters injection chamber 162 through a check valve 172 located at the top of axial passage 174*a* and is discharged through an injection passage 174 formed in branches 174*a*, 174*b*, 174*c* contained in spring housing 127, nozzle stop 130 and tip nozzle housing 124, respectively.

Figure 2B:
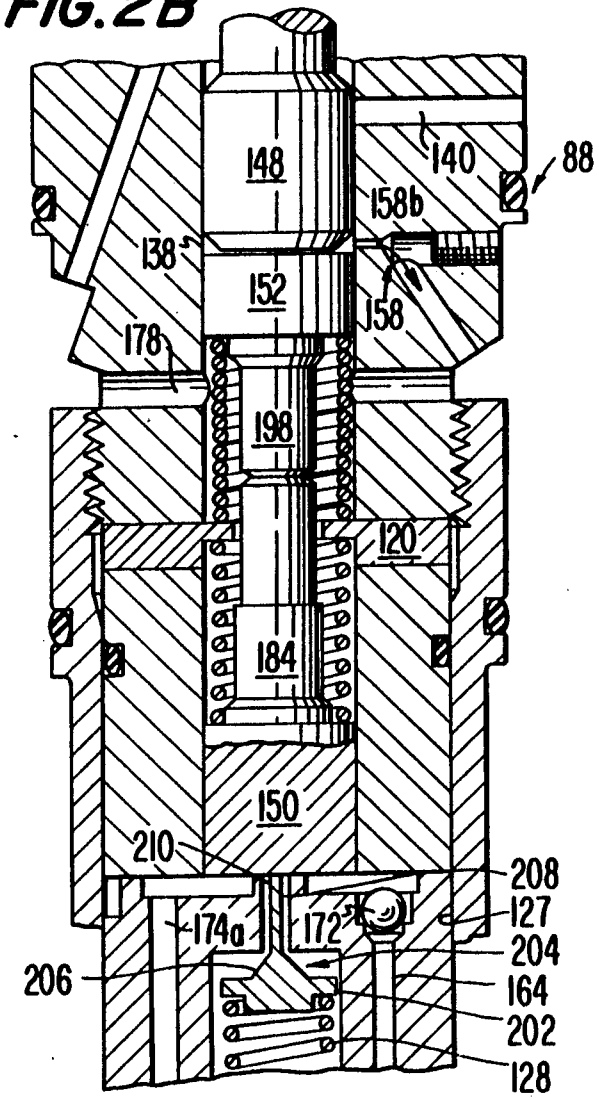
FIG. 2B is a view similar to FIG. 2A, but wherein the injection plunger has reached its lowermost position following an injection event and the spill valve is shown displaced by the plunger into an open position, whereby fuel is spilled from the injection chamber.
Figure 2A:
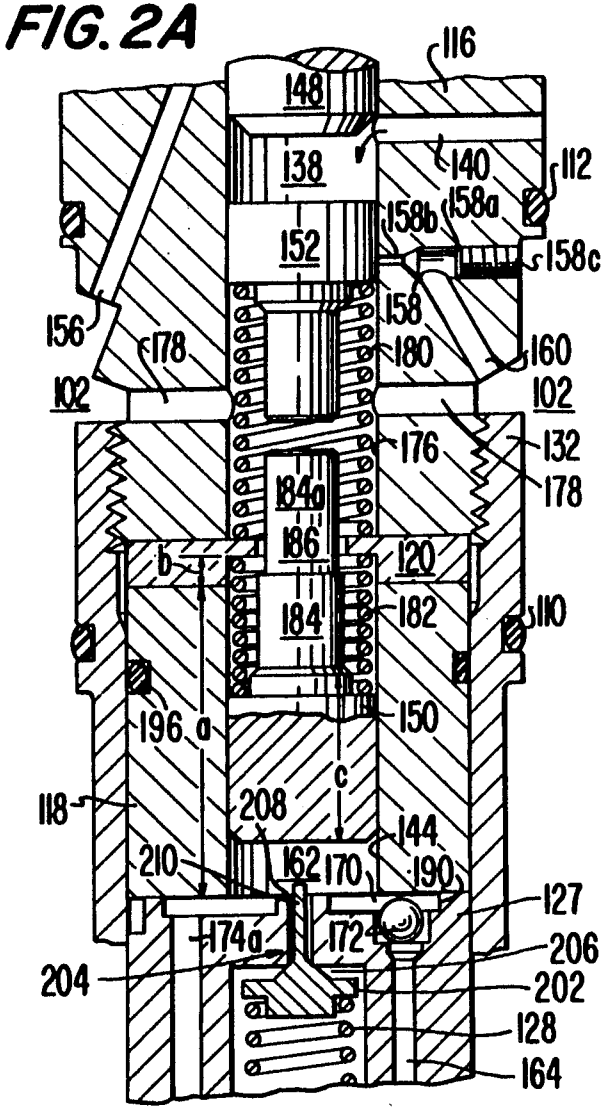
FIG. 2A is a broken-away cross-sectional view of the injector illustrated in FIG. 1, wherein both timing fluid and fuel are being metered into the injection chamber and timing chamber, respectively, and the injection chamber spill valve is biased into its closed position.
Figure 3:
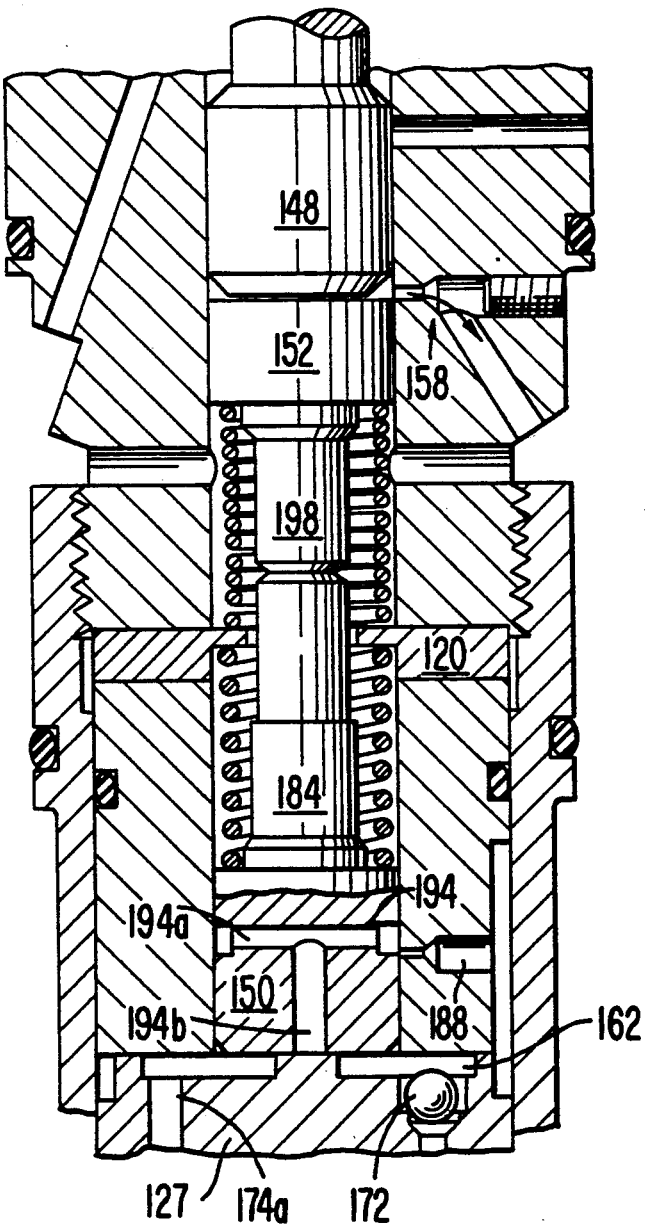
FIG. 3 PRIOR ART
FIG. 3 is a broken-away cross-sectional view of a fuel injector in accordance with U.S. Pat. No. 4,463,901, including a conventional spill port arrangement for spilling fuel from the injection chamber.
Figure 1:
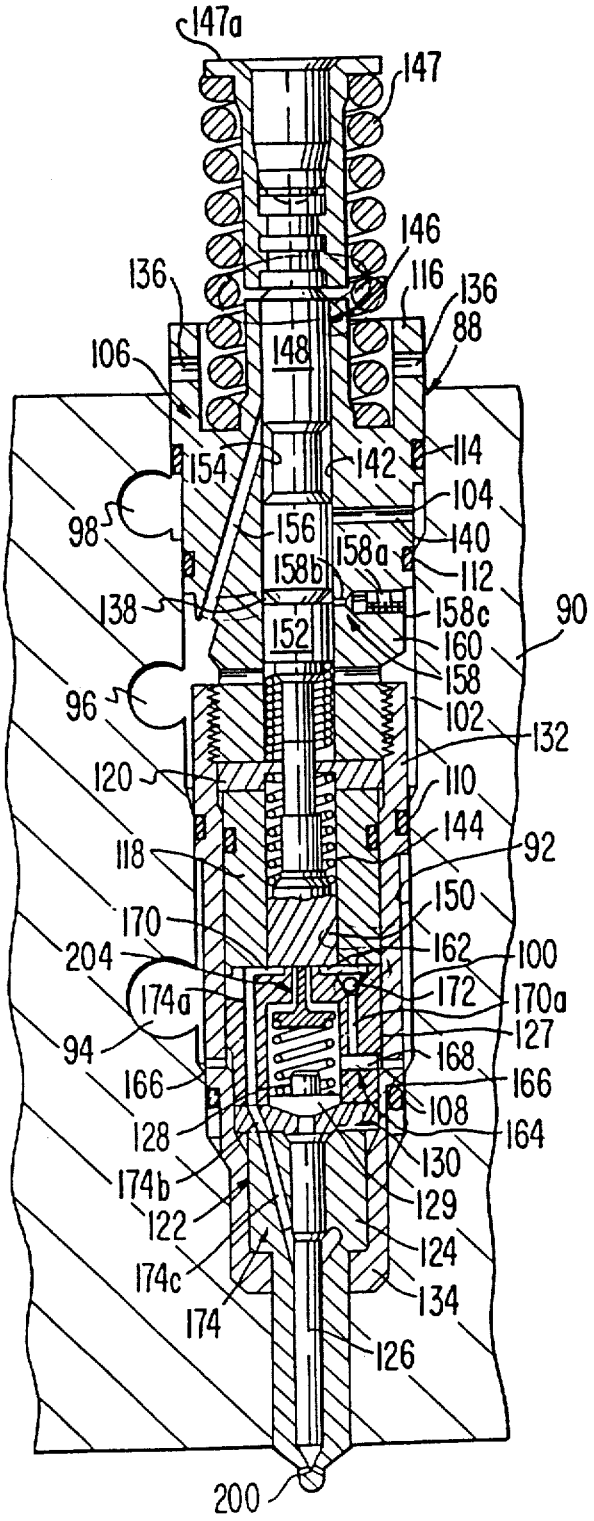

For a clearer understanding of the structure and function of the injector embodiment of FIG. 1, reference is now made to FIG. 2A which is a broken-away, enlarged cross-sectional view of the central section of the injector assembly 88.

FIG. 2A shows the condition of a compensation chamber 176 formed between intermediate plunger section 152 and lower plunger section 150. Compensation chamber 176 is kept filled with fuel from annular flow chamber 102 through radial auxiliary passages 178 because the engine drain flow path is maintained at a constant low pressure. The upper and lower compression springs 180 and 182 are carefully chosen and the dimensions of compensation chamber 176 are carefully controlled to produce a known and predictable response to pressure variation supplied to the timing chamber 138 and injection chamber 162. For example, experiments have shown that predictable results are obtained if the length of lower compression spring 182 is held to + or −0.001 inches and the spring rate is held to + or −2%. Dimension a of the lower injection barrel 118 should be held to + or −0.001 inches, dimension b of the injection spring retainer should be held to + or −0.001 inches and dimension c of the lower plunger section 150 should also be held to + or −0.0015 inches. If shims are used, a lower cost spring may be substituted having a spring length of + or −0.005 inches and a spring rate of + or −0.6%.

Lower plunger section 150 includes an upwardly directed extension 184 having a reduced diameter portion 184*a* which passes through an aperture 186 contained in injection spring retainer 120. A sufficient radial space exists between portion 184*a* and aperture 186 to allow fuel to pass readily back and forth between the portions of compensation chamber 176 located above and below injector spring retainer 120. The lower portion of upwardly directed extension 184 has a diameter which is larger than the diameter of aperture 186 to form thereby a stop for lower plunger section 150 which defines the maximum volume of injection chamber 162.

FIG. 2A clearly illustrates the injection chamber spill valve of the present invention. The side of inner element 202 opposite spring 128 has a conically shaped valve disk 206 which, in a closed position, is seated in a passage 208 extending through an upper wall of tip valve spring housing 127 which also forms a lower boundary of the fuel injection chamber 162. Conical valve disk 206 of inner spill valve element 202 terminates in an elongated contact piece 210 which extends through passage 208 in the upper end of spring housing 126.

As can be seen in FIG. 2A, in a state where plunger 150 is retracted from its lowermost position, contact piece 210 extends through passage 208 and protrudes into fuel injection chamber 162. Spring 128 simultaneously acts to bias tip valve element 126 and spill valve element 202 into their respective closed positions. Conically shaped valve disk 206 sealably engages passage 208 which is, in the preferred embodiment, cylindrical in shape. Valve element 202 remains seated against the end of passage 208 until an end face of plunger 150 comes into contact with the tip of contact piece 210. Spring 128 is chosen to ensure that tip valve element 126 opens and closes in the desired manner. A spring chosen to optimize this operation will typically be suitable for providing proper operation of spill valve 204. High injection pressures in chamber 162 will not unseat element 202 due to the small surface area of element 202 subjected to the injection pressure and thus the small force thereon created by the injection pressure. Accordingly, valve 204 remains securely closed until plunger 150 reaches the end of its injection stroke.

The opening point of the valve can be accurately controlled by correct tolerancing of the parts or by selection of the correct length of contact piece 210 for the assembly. Such calibration is simpler and less costly than forming and precisely locating a spill port in the injector barrel and a corresponding spill groove on the injector plunger by EDM, as in the prior art.

FIG. 2A illustrates a period during injector operation in which timing fluid flows into timing chamber 138 to cause intermediate plunger section 152 to move in a downward direction for a distance which is proportional to the pressure of the timing fluid. Similarly, fuel is being metered through fuel supply passage 164 past a check valve 172 into injection chamber 162. The amount of fuel actually metered into chamber 162 will depend upon the pressure of the fuel supplied through fuel supply passage 164.

Referring now to FIG. 2B, the injector assembly 88 is shown in a condition achieved at the end of the injection event wherein upper injector plunger 148 has completed its downward stroke during which timing fluid passage 140 was closed to form a hydraulic link between the upper plunger section and intermediate plunger section 152. As the downward stroke continues, the downwardly directed extension 198 of intermediate plunger section 152 comes into contact with the upwardly directed extension 184 of the lower plunger section 150 to cause the injection event to commence. As the downward stroke of the upper injector section 148 continues, substantially all of the fuel metered into injection chamber 162 is discharged through the injection passage 174 and out of injection orifice 200 (see FIG. 1). It is at this time that the end face of plunger 150 contacts the tip of contact piece 210 and thereby opens spill valve 204. Since the fuel supplied into spring housing 127 through radial passage 168 (see FIG. 1) is at low pressure relative to the injection pressure at the time spill valve 204 is opened, any remaining fuel is expelled from the injection through passage 208 and into spring housing 127. The pressurized fuel entering spring housing 127 temporarily increases the pressure therein. Furthermore, spring 128 is compressed to open valve 204. Thus, the spill valve arrangement advantageously utilizes the spill forces to assist in closing the tip valve of the closed nozzle. Termination of the injection event is thereby improved over prior injectors using spill ports wherein spilled fuel is returned to the fuel supply.

In order to hold lower injector plunger 150 in its lowermost position as illustrated in FIG. 2B, the timing fluid discharge passage 158 is located to be opened just before lower injector plunger 150 reaches its lowermost position. Accordingly, the timing fluid which has been metered into timing chamber 138 will be discharged through throttling orifice **158*b*. The size of orifice 158*b* is chosen so as to bring a substantial hold down pressure throughout the remainder of the downward movement of the upper plunger section 148**.

The present invention has been described in terms of a preferred embodiment thereof. Modifications and other embodiments within the scope and spirit of this invention will occur to those having ordinary skill in the art.

INDUSTRIAL APPLICABILITY

The fuel injector design described above is able to achieve accurate and independent control over fuel metering and injection timing by means of a relatively simple and easily manufactured injector. Such injectors would be usable in a broad range of internal combustion engines, especially of the compression ignition type. A particularly appropriate application of the subject injector design would be for a small compression ignition engine suitable for trucks, automobiles, other types of vehicles and stationary power plant applications.

What is claimed is:

1. A unit fuel injector for periodically injecting fuel into the combustion chamber of an internal combustion engine, comprising:

(a) an injector body containing a central bore and a orifice through which fuel may be injected into the combustion chamber;

(b) a reciprocating plunger mounted in said bore to form an injection chamber in which fuel may be pressurized by said plunger for injection through said injection orifice as said plunger is advanced during its injection stroke;

(c) fuel supply means for providing a quantity of fuel to said injection chamber on a periodic basis; and (d) spill valve means for spilling fuel from said injection chamber at the end of each fuel injection stroke of said plunger, said spill valve means being openable via mechanical contact of said spill valve means with said plunger.

2. A periodic fuel injector according to claim 1, wherein said spill valve means is located at a lower end portion of said injection chamber, is spring biased to a closed position and is openable by an end face of said plunger coming into contact with said spill valve means at the end of an injection stroke.

3. A periodic fuel injector according to claim 2, wherein said spill valve means comprises an opening in a lower wall of said injection chamber, an inner valve element movable therein, and a spring biasing said valve element into said closed position such that said valve element seals said opening and a contact piece of said valve element protrudes into said injection chamber a predetermined distance for making contact with said plunger.

4. A periodic fuel injector according to claim 3, further comprising a tip valve assembly for opening and closing said injection orifice, said tip valve assembly including a tip valve element spring biased to a position closing said injection orifice and being openable by generation of a predetermined amount of fuel pressure in said fuel injection chamber.

5. A periodic fuel injector according to claim 4, wherein said tip valve element is biased to a closed position by the spring which biases said valve element, said spring being housed in a tip valve spring housing of said tip valve assembly, with its lower end seated at an upper portion of said tip valve element and its upper end being seated against a side of said valve element opposite said contact piece.

6. A periodic fuel injector according to claim 3, wherein said inner valve element comprises a conical portion seatable in said opening.

7. A periodic fuel injector according to claim 5, wherein fuel which is spilled through said valve means flows into said tip valve spring housing and assists said spring in biasing the tip valve element to a closed position.

8. A closed nozzle periodic fuel injector, comprising:

(a) an injector body containing a central bore and a reciprocating plunger mounted in said bore;

(b) an injection chamber formed in said bore, said reciprocating plunger being arranged to reciprocate within said bore for pressurizing fuel in said injection chamber and injecting fuel through an injection orifice provided at a lower end of said injector body;

(c) fuel supply means for providing a quantity of fuel to said injection chamber on a periodic basis;

(d) a tip valve assembly for opening and closing said injection orifice, said tip valve assembly including a tip valve element spring biased into a closed position; and (e) spill valve means for spilling fuel at the end of each fuel injection stroke of said plunger from said injection chamber into a spring housing of said tip valve assembly such that the spilled fuel assists in biasing the tip valve element into the closed position.

9. A closed nozzle periodic fuel injector according to claim 8, wherein said spill valve means is located at a lower end portion of said injection chamber, is spring biased to a closed position and is openable by an end face of said plunger coming into contact with said spill valve means at the end of an injection stroke.

10. A closed nozzle periodic fuel injector according to claim 9, wherein said spill valve means comprises an opening in a lower wall of said injection chamber, an inner valve element movable therein, and a spring biasing said valve element into said closed position such that said valve element seals said opening and a contact piece of said valve element protrudes into said injection chamber a predetermined distance for making contact with said plunger.

11. A closed nozzle periodic fuel injector according to claim 10, wherein said inner valve element comprises a conical portion seatable in said opening.

12. A closed nozzle periodic fuel injector according to claim 8, wherein fuel spilled into said spring housing is recirculated to a fuel supply passage of said metering means.

13. A fuel injector for periodically injecting fuel of a variable quantity on a cycle to cycle basis as a function of the pressure of fuel supplied to the injector from a source of fuel and at a variable time during each cycle as a function of the pressure of a timing fluid supplied to the injector from a source of timing fluid, comprising:

(a) an injector body containing a central bore and an injector orifice at the lower end of the body;

(b) a reciprocating plunger assembly including an upper plunger section, an intermediate plunger section and a lower plunger section serially mounted within said central bore to define (1) a variable volume injection chamber located between said lower plunger section and the lower end of said injector body containing said injection orifice, said variable volume injection chamber communicating during a portion of each injector cycle with the source of fuel, (2) a variable volume timing chamber located between said upper and intermediate plunger sections, said timing chamber communicating for a portion of each injector cycle with the source of timing fluid, and (3) a variable volume compensation chamber located between said intermediate and lower plunger sections;

(c) biasing means located within said variable volume compensating chamber for biasing said intermediate and lower plunger sections in opposite directions to collapse said timing and injection chamber, respectively, while tending to expand said compensating chamber; and (d) spill valve means for spilling fuel from said injection chamber at the end of each injection stroke of said lower plunger section said spill valve means being operable via mechanical contact of said valve means with said plunger.

14. A fuel injector according to claim 13, wherein said injector body contains a timing fluid supply passage communicating at one end with a source of timing fluid and communicating at the other end with said timing chamber only when said upper plunger section is adjacent its uppermost position within said central bore.

15. A fuel injector according to claim 14, wherein said injector body contains a timing fluid drain passage communicating at one end with a fluid drain and communicating at the other end with said timing chamber only when said upper plunger section is adjacent is lowermost position within said central bore.

16. A fuel injector according to claim 13, wherein said spill valve means is located at a lower end portion of said injection chamber, is spring biased to a closed position and is openable by an end face of said lower plunger section coming into contact with said spill valve means at the end of an injection stroke.

* * * * *

UNITED STATES PATENT AND TRADEMARK OFFICE

CERTIFICATE OF CORRECTION

PATENT NO. : 5,094,397

DATED : March 10, 1992

INVENTOR(S) : Lester L. Peters, et al

It is certified that error appears in the above-identified patent and that said Letters Patent is hereby corrected as shown below:

The title page, should be deleted to be replaced with the attached title page.

The drawing sheet, consisting of Fig. 1, should be deleted to be replaced with the drawing sheet consisting of Fig. 1, as shown on the attached page.

Signed and Sealed this

Eighth Day of June, 1993

*Attest:*

Michael K. Kirk

MICHAEL K. KIRK

*Attesting Officer*

*Acting Commissioner of Patents and Trademarks*

US005094397A

United States Patent [19]

Peters et al.

[11] Patent Number: 5,094,397

[45] Date of Patent: Mar. 10, 1992

[54] UNIT FUEL INJECTOR WITH INJECTION CHAMBER SPILL VALVE

[75] Inventors: Lester L. Peters; Julius P. Perr, both of Columbus, Ind.

[73] Assignee: Cummins Engine Company, Inc, Columbus, Ind.

[21] Appl. No.: 653,704

[22] Filed: Feb. 11, 1991

[51] Int. Cl.[5] ..... F02M 47/02

[52] U.S. Cl. ..... 239/88; 239/89; 239/91; F02M/47/02

[58] Field of Search ..... 239/88-91, 239/93, 95, 124, 125

[56] References Cited

U.S. PATENT DOCUMENTS

| | | | |
|---|---|---|---|
| 1,852,191 | 4/1932 | Salisbury | 239/88 |
| 2,055,580 | 9/1936 | Larsson et al. | 239/91 |
| 2,762,654 | 9/1956 | Purchas, Jr., et al | 239/90 |
| 4,235,374 | 11/1980 | Walter et al. | 239/90 |
| 4,410,137 | 10/1983 | Perr | 239/95 |
| 4,420,116 | 12/1983 | Warlick | 239/95 |
| 4,463,901 | 8/1984 | Perr et al. | 239/95 |
| 4,471,909 | 9/1984 | Perr | 239/89 |
| 4,699,320 | 10/1987 | Sisson et al. | 239/90 |

*Primary Examiner*—Andres Kashnikow
*Assistant Examiner*—Lesley Morris
*Attorney, Agent, or Firm*—Sixbey, Friedman, Leedom & Ferguson

[57] ABSTRACT

A unit fuel injector assembly (88) periodically injects fuel of a variable quantity on a cycle to cycle basis as a function of the pressure of fuel supplied to the injector from a source of fuel and at a variable time during each cycle as a function of the pressure of the timing fluid supplied to the injector from a source of timing fluid. A reciprocating plunger assembly (146) is received within the injector body (106) and includes an upper plunger section (148), a lower plunger section (150) and an intermediate plunger section (152) in order to define a variable volume timing chamber (138), a variable volume injection chamber (162) and a variable volume compensation chamber (176). Biasing means including an upper compression spring (180) and lower compression spring (182) are arranged in the compensation chamber (176) to independently bias the lower plunger section (150) and the intermediate plunger section (152) in opposite directions to tend to collapse the timing chamber (138) and injection chamber (162). Provision is made for causing both the timing chamber (138) and injection chamber (162) to be spilled at the end of each injection event. A spill valve (204) for spilling fuel from the injection chamber (162) is located at a lower end portion of the injection chamber (162), is spring biased to a closed position and is openable by an end face of the injection plunger (150) coming into contact with a contact piece (210) of a spill valve (204) at the end of an injection stroke.

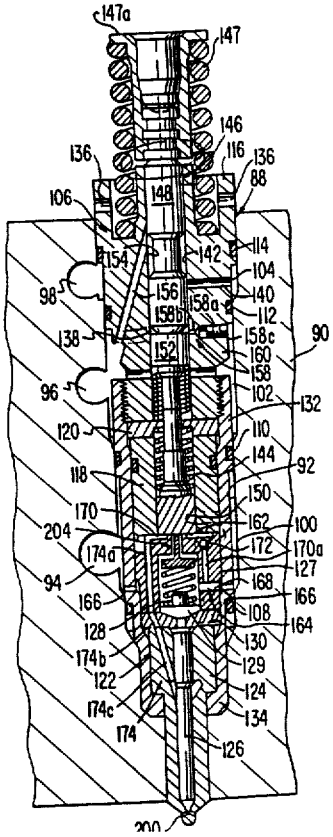

16 Claims, 3 Drawing Sheets